US006183347B1

(12) United States Patent
Shaw

(10) Patent No.: US 6,183,347 B1
(45) Date of Patent: Feb. 6, 2001

(54) SUSTAINED SURFACE STEP SCRUBBING

(75) Inventor: James S. Shaw, Hampton Falls, NH (US)

(73) Assignee: General Electric Company, Cincinnati, OH (US)

( * ) Notice: Under 35 U.S.C. 154(b), the term of this patent shall be extended for 0 days.

(21) Appl. No.: 09/379,917

(22) Filed: Aug. 24, 1999

(51) Int. Cl.[7] ..... B24B 1/00

(52) U.S. Cl. ..... 451/36; 451/29; 451/30; 451/40; 451/90; 451/102; 451/342

(58) Field of Search ..... 451/36, 38, 39, 451/40, 90, 94, 102, 342, 29, 30, 31

(56) References Cited

U.S. PATENT DOCUMENTS

| | | | |
|---|---|---|---|
| 5,146,716 | | 9/1992 | Lynn . |
| 5,207,034 | | 5/1993 | Lynn . |
| 5,234,470 | | 8/1993 | Lynn . |
| 5,681,216 | * | 10/1997 | Jennings . |
| 5,766,368 | * | 6/1998 | Bowers . |
| 5,810,644 | * | 9/1998 | Schmidt . |

OTHER PUBLICATIONS

U.S. application No. 09/217,672, filed Dec. 21, 1998, entitled: Sustained Surface Step Scrubbing. Inventor: James S. Shaw General Electric Company assignee.

Sponge–Jet, Inc., "Sponge Blasting System," brochure, 1997.

Sponge–Jet, Inc, "Material Safety Data Sheets, " Aug. 30, 1996.

Sponge–Jet, Inc. "Case Histories, " undated.

U.S. patent application Ser. No. 09/358,643, filed Jul. 23, 1999, (Docket 13DV–12926).

U.S. patent application Ser. No. 09/ , concurrently filed, (Docket 13DV–13148).

* cited by examiner

*Primary Examiner*—David A. Scherbel
*Assistant Examiner*—Willie Berry, Jr.
(74) *Attorney, Agent, or Firm*—Andrew C. Hess; Gerry S. Gressel

(57) ABSTRACT

A workpiece includes a surface adjoining an aperture. The aperture is filled with a plug to provide a step adjoining the surface. A stream of pliant shot in a carrier fluid is discharged at a shallow angle of incidence against the plug and directed toward the step for selective abrasion thereof.

27 Claims, 3 Drawing Sheets

SUSTAINED SURFACE STEP SCRUBBING

BACKGROUND OF THE INVENTION

The present invention relates generally to manufacture and repair of machine parts, and, more specifically, to surface finishing of such parts.

Machines are assemblies of various parts which are individually manufactured and assembled. Machines typically include metal parts, although synthetic and composite parts may also be used. And, each part requires specialized manufacturing.

For example, metal parts may be fabricated from metal stock in the form of sheets, plates, bars, and rods. Metal parts may also be formed by casting or forging. Such parts may be machined to shape in various manners.

Machining requires the selective removal of material to configure the part to its final shape and size within suitable manufacturing tolerances, typically expressed in mils, and with a suitable surface finish which is typically smooth or polished without blemish.

Each step in the manufacturing process of machine parts adds time and expense which should be minimized for producing a competitively priced product. It is desirable for each subsequent step in the manufacturing process to avoid damaging previously finished portions of the part which would then require additional corrective finishing steps.

Gas turbine engines are an example of a complex machine having many parts requiring precise manufacturing tolerances and fine surface finishes. A typical engine includes a multistage compressor for pressurizing air which is mixed with fuel in a combustor and ignited for generating hot combustion gases which flow downstream through one or more turbine stages that extract energy therefrom. A high pressure turbine powers the compressor, and a low pressure turbine provides output power, such as powering a fan disposed upstream from the compressor in an aircraft engine application.

The engine thusly includes various stationary components, and various rotating components which are typically formed of high strength, state of the art metal and composite materials. The various parts undergo several steps in their manufacturing and are relatively expensive to produce.

Of particular interest in manufacturing compressor and turbine rotor disks is maintaining smooth surface finish thereof and large radii along edges therein for minimizing stress during operation. Rotor disks support corresponding rotor blades around the perimeters thereof, and are subject to substantial centrifugal force during operation. The centrifugal force generates stress in the rotor disk which can be concentrated at sharp edges or small corners in the disk, which must therefore be suitably eliminated.

In one type of rotor disk, axial dovetail slots are formed through the perimeter of the disk for retaining rotor blades having corresponding axial dovetails. The dovetails include one or more pairs of dovetail tangs, in the exemplary form of a fir tree, which mate in complementary dovetail slots formed between corresponding disk posts.

The dovetail slots are typically manufactured by broaching wherein successively larger cutting tools cut the perimeter of the rotor disk to form the desired dovetail slots in a sequential operation. Each dovetail slot is broached in turn until the full complement of slots is formed around the perimeter of the disk.

The disk prior to the broaching operation has already undergone several steps in the manufacturing process including precision machining of most of its external surface. Broaching of the dovetail slots in the perimeter of the disk typically results in sharp corners or edges on the entrance side of the slot, and burrs on the exit side of the slot. The sharp entrance edges and burred exit edges require further processing to form suitably large radii which correspondingly reduce stress concentrations during operation of the rotor disk.

Deburring and radiusing of the rotor disk typically requires several additional processes in view of the complexity of the rotor disk and the complexity of the dovetail slots therein. For example, the individual rotor disk after broaching may be turned inside a bed of abrasive particles, such as the Sutton Blend (trademark) process, used to initially deburr the slots and form suitable corner radii therealong. However, the Sutton Blend process is directional and is effective for radiusing only some of the edges of the serpentine dovetail slots.

Accordingly, the disk undergoes additional processing for benching or further abrading slot edges, typically near their bases, by hand or robotically. One form of benching is conventionally known as Harperizing which is a trademark process using cloth wheels having abrasive therein.

This process is then followed by a conventional abrasive flow for blending the benched regions as required for achieving suitable radii.

These various steps require corresponding processing time, and are correspondingly expensive. And, hand benching always includes the risk of inadvertent damage to the rotor disk rendering it defective, and requiring scrapping thereof at considerable expense.

Furthermore, the rotor disk includes other machined features which may have sharp edges and burrs thereon which also require processing. For example, an annular row of axial holes extend through the web of the disk below the dovetail slots which receive retaining bolts during assembly. These bolt holes are suitably drilled, and like broaching, have sharp entrances and sharp exits with burrs thereon. These edges are also suitably radiused using the processes described above, which adds to the time and expense for disk manufacture.

The deburring and radiusing processes described above are used selectively for the edges being treated to avoid or minimize any changes to the remaining surface of the rotor disk which is typically smooth with a fine surface finish. Any damage to that finish requires additional processing and corresponding time and expense.

Accordingly, it is desired to provide an improved process for selective surface treating a workpiece, having little or no adverse effect on adjoining surface finish thereof.

BRIEF SUMMARY OF THE INVENTION

A workpiece includes a surface adjoining an aperture. The aperture is filled with a plug to provide a step adjoining the surface. A stream of pliant shot in a carrier fluid is discharged at a shallow angle of incidence against the plug and directed toward the step for selective abrasion thereof.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
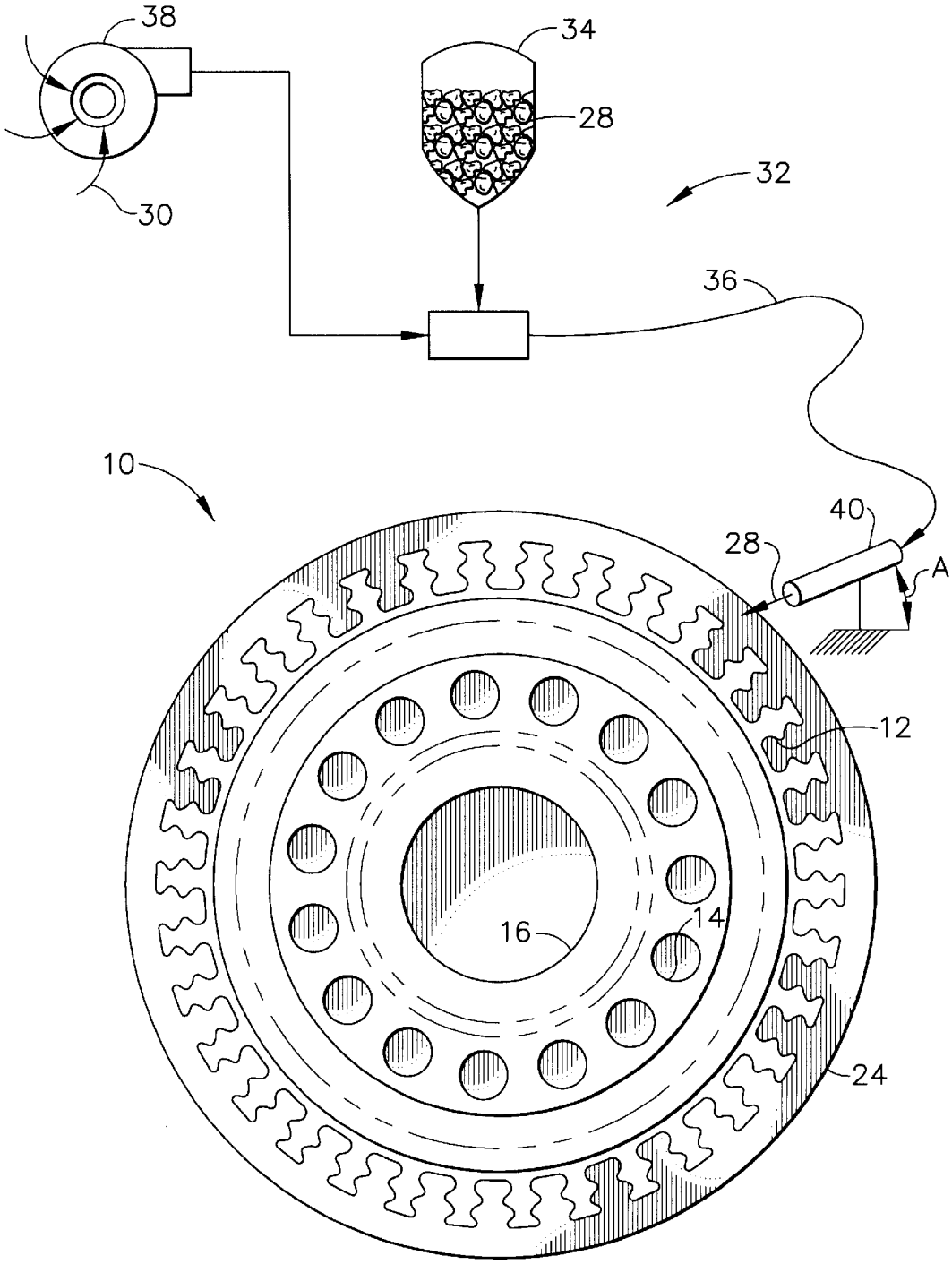
FIG. 1 is a schematic representation of an apparatus for scrubbing a surface of a rotor disk in accordance with an exemplary embodiment of the present invention.

Illustrated in FIG. 1 is a workpiece 10 in the exemplary form of a gas turbine engine rotor disk for a turbine although a corresponding rotor disk for a compressor may also be processed. The rotor disk is formed of a suitable metal for its intended use in the gas turbine engine for operating at high speed and at temperature while withstanding loads generated therein, such as centrifugal loads.

In this exemplary embodiment, the disk 10 includes a plurality of circumferentially spaced apart axial dovetail slots 12 formed in the perimeter thereof for receiving corresponding axial dovetails of rotor blades (not shown) in a conventional manner. The dovetail slots are defined by corresponding disk posts having complementary tangs or lobes. The dovetail slots have an exemplary fir tree configuration, with serpentine edges and pressure faces which complement the blade dovetails.

The rotor disk also includes an annual row of axial through holes 14 disposed radially inwardly of the dovetail slots for receiving mounting bolts (not shown) during assembly. The disk also includes a center bore 16 for reducing its weight.

Figure 2:
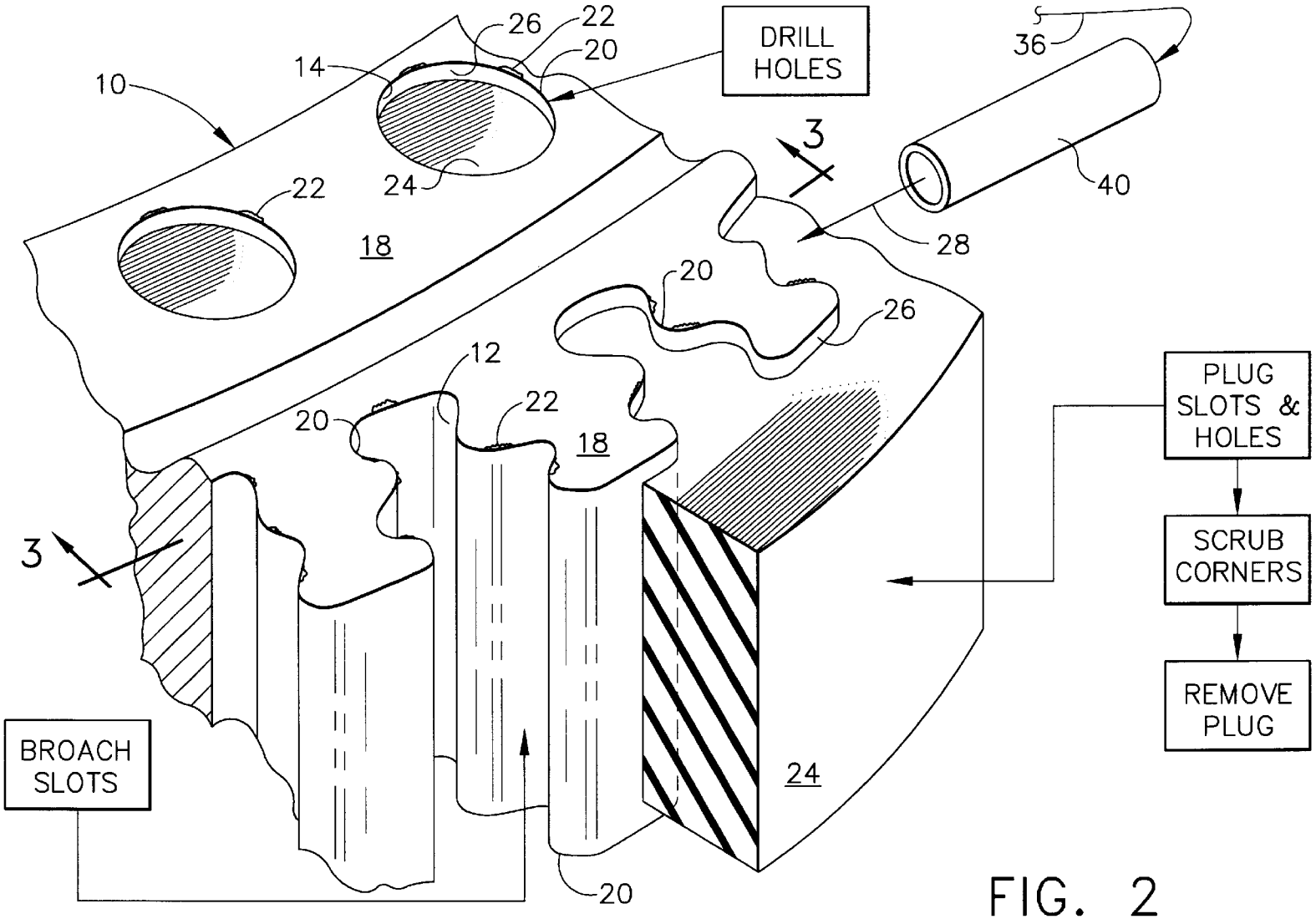
FIG. 2 is an enlarged, partly sectional isometric view of a portion of the disk illustrated in FIG. 1 having dovetail slots and bolt holes filled with a plug for undergoing surface scrubbing along edges thereof in accordance with an exemplary embodiment.

As shown in FIG. 2, the rotor disk 10 may be manufactured in any conventional manner to its required shape and configuration, including the dovetail slots 12 and bolt holes 14 therein. The disk further includes external side surfaces 18 on both axial sides thereof which have a smooth finish formed in any suitable manner.

In a typical manufacturing sequence, the individual dovetail slots 12 are formed axially in the perimeter of the rotor disk by conventional broaching. In broaching, a series of increasingly larger cutting tools are drawn across the perimeter of the disk for removing metal therefrom in stages until the resulting dovetail slot or aperture is formed thereacross. The dovetail slots 12 intersect the axial side surfaces 18 of the disk at corresponding edges or corners 20 which have serpentine profiles as they follow the outline of the fir tree profile.

Figure 3:
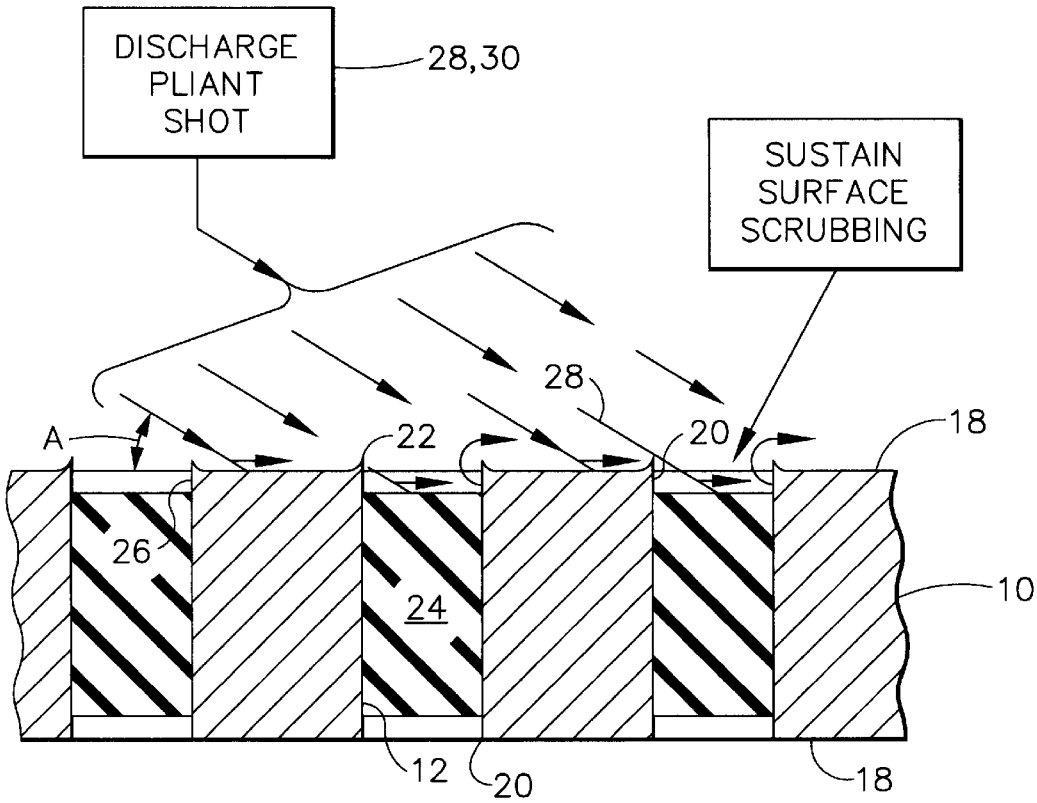
FIG. 3 is an elevational sectional view through a portion of the perimeter of the rotor disk illustrated in FIG. 2 and taken along line 3—3.

As shown in FIGS. 2 and 3, the broach entrance side of the dovetail slots have relatively sharp corners 20 between the slots 12 themselves and the adjoining side surfaces 18. The broach exit sides of the dovetail slots have similarly sharp corners, and typically also include burrs 22 protruding outwardly from various portions of the slot corners.

In accordance with the present invention, an improved method for deburring the slot corners as well as additionally radiusing those corners by abrasion is provided, which also protects the adjoining surface finish of the disk.

As initially shown in FIG. 2, the dovetail slots 12 are firstly filled with a plug or filler 24 to provide a recess or step 26 at the corner 20 adjoining the exposed surface 18. The plug 24 may be suitably molded into the dovetail slots, and is formed of a suitable synthetic material such as polyurethane rubber, for example. Polyurethane is an elastomeric material and has particular utility in the present invention for protecting the inside or hidden portions of the dovetail slots and is readily removable after surface treatment.

FIG. 1 illustrates schematically an apparatus for effecting a new method of surface treatment of the rotor disk in accordance with a preferred embodiment of the present invention. The apparatus is configured for discharging or ejecting a stream of pliant or soft shot 28 in a carrier fluid 30, such as compressed air, at a shallow angle of incidence A against the plug 24 and directed toward the corner 20 for selective abrasion thereof. The pliant shot and shallow surface angle cause scrubbing of the shot laterally along the surface 18 and plug 24 for selectively removing target material from the slot corners 20, including any burrs 22 thereon.

As shown in FIG. 3, the shot 28 is directed at the disk surface 18 and the recessed plug 24 therein at the shallow angle of incidence within the carrier fluid 30. The shot is pliant and resilient, and initially compresses as it impacts the disk and plug surfaces with little or no rebounding in the region of the impact site.

The shallow incidence angle and entraining carrier fluid ensure that the shot is scrubbed laterally or generally parallel along the plug for selectively removing material at the corner 20 upon impingement thereagainst.

As indicated schematically in FIG. 3, the stream of shot 28 is as wide as practical for maximizing surface area treatment, and thusly may be directed over one or more of the dovetail slots and adjoining surface 18 in parallel. The shot therefore scrubs both the plug 24 and the adjoining surface 18, but due to the scrubbing action thereof selectively removes target material from the corners 20 while protecting the disk surface 18 itself. In the Sustained Surface Scrubbing ($S^3$) process of the present invention, the shot scrubs both the surface and the plug for selectively removing material from the slot corners 20 distinctly from the adjoining surface which is protected.

This selective material removal is effected by scrubbing the shot 28 generally parallel to the exposed disk surface 18 for protection thereof, with the shot 28 also being scrubbed generally parallel to the plug 24 for its protection. However, upon traveling along the plug the shot intercepts the raised corners 20 and any burrs 22 thereon which are then abraded.

Since the plug 24 is preferably recessed below the exposed disk surface 18 to define the step 26, the exposed portion of the slot corner 20 protrudes outwardly from the plug. Scrubbing of the pliant shot along the surface of the plug removes little, if any, material therefrom, whereas upon directly impinging the slot corner 20 substantially perpendicular thereto, significant abrasion thereof is effected. Upon impinging the corner 20, the shot is carried by the carrier fluid and travels over the corner and continues abrasion thereof until the shot travel generally parallel along the adjoining surface 18 with little, if any, abrasion thereof.

Accordingly, sustained surface scrubbing has little abrasion effect while traveling parallel to a surface, but has significant abrasion effect upon impinging a protruding target such as the slot corners exposed at the recessed plug 24.

In this way, the pliant shot 28 may be preferentially directed at the surface of the rotor disk at the shallow incidence angle for protecting the surface thereof from abrasion, while concentrating abrasion primarily only at the exposed slot corners 20 within the impact site of the shot stream. Any burrs 22 on the slot corners are readily removed since they protrude into the shot stream directed thereagainst, and, the remaining slot corners 20 themselves may be additionally abraded for radiusing thereof.

Figure 4:
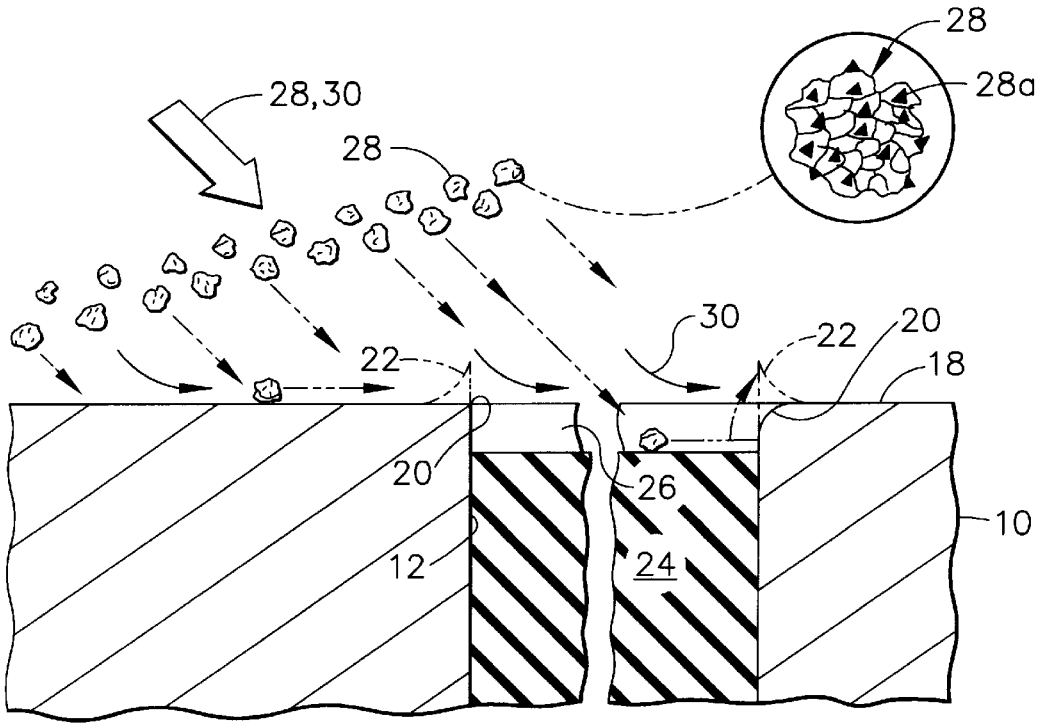
FIG. 4 is an enlarged, elevational view of one of the dovetail slots illustrated in FIG. 3 undergoing scrubbing thereof.

As shown in more detail in FIG. 4, by scrubbing the slot corner 20 with the shot 28, a precise radius may be formed thereat terminating at the surface of the plug 24. In this way, the plug may be predeterminedly recessed below the disk surface 18 for providing a precise arcuate corner 20 down to the level of the plug. Since the plug itself is not significantly abraded during operation, the profile of the arcuate corner 20 formed by scrubbing is precisely controlled by placement of the plug itself.

Correspondingly, since the shot is directed over the surface of the disk at the preferred shallow incidence angle therewith, the simultaneous scrubbing of the disk surface 18 and slot corner 20 within the shot stream selectively removes material from primarily only the corner 20 without significantly changing finish of the adjoining disk surface itself. In this way, the disk surface is not damaged during the scrubbing process, and additional surface treatment is not required therefor.

As shown in greater detail in FIG. 4, the stream of shot 28 impacts the surfaces of the disk and plug over the corresponding impact site including at least a portion of the slot edge or corner 20. The pliant shot compress as they engage the impact site and travel parallel therealong due to their kinetic energy, as well as the blanket of the carrier fluid 30 which flows thereover. In this way, the sustained surface scrubbing effect is maintained by the stream of shot for a finite distance along the surfaces of the disk and plug with little or no appreciable rebounding therefrom.

In the preferred embodiment illustrated in FIG. 4, the shot 28 comprise a light-weight resilient material such as sponge, rubber, felt, plastic, foam, or other resilient material. The shot may have open or closed cells. The shot preferably includes abrasive particles 28*a* imbedded therein, although in alternate embodiments abrasive may be omitted. Suitable abrasives include particles of various minerals, metal oxides, plastics, and black walnut shell, for example.

One type of suitable pliant shot is commercial available from Sponge-Jet Inc. of Eliot, Maine under the tradename of Sponge Media. This sponge media includes a polyurethane open-cell carrier in which is impregnated different types of abrasive material for different abrasive performance. And, one form of the sponge media is without abrasive.

Equipment for discharging the pliant shot is also commercially available from Sponge-Jet Inc., but is modified and operated differently for purposes of the sustained surface scrubbing of the present invention. In conventional practice, the sponge media is blasted perpendicularly, or close thereto against a surface of a workpiece for removing coatings thereof while profiling the underlying surface. Accordingly, impingement of the sponge media not only removes coatings atop the surface, but also removes underlying material of the surface itself which changes its surface finish.

As indicated above, the rotor disk 10, as an exemplary workpiece, typically has a finished surface prior to scrubbing which is preferably protected when deburring or radiusing the slot corners. Suitable discrimination between the burrs 22 to be removed or the corners 20 to be radiused and the finished surface 18 of the disk is effected by discharging the pliant shot at the shallow incidence angle for being constrained by the carrier fluid to sustain parallel scrubbing action thereof.

As initially shown in FIG. 1, a conventional blasting apparatus 32 is illustrated and is commercially available from Sponge-Jet Inc., and is modified in accordance with the present invention for use in achieving sustained surface scrubbing. The apparatus includes a hopper 34 in which the pliant shot 28 is stored. The hopper is joined in flow communication with a delivery conduit 36 through which the shot is discharged.

An air compressor or pump 38 is operatively joined to the delivery conduit 36 for providing air as the carrier fluid 30 under suitable pressure for carrying and discharging the shot in a stream through a suitable nozzle 40.

The nozzle 40 may be configured for discharging the shot in a dispersed stream for covering a finite area of the rotor surface. By laterally spreading the shot stream from the nozzle, increased surface coverage may be obtained for decreasing the total processing time for the entire rotor disk. Low pressure air of about 30–40 psi is preferred to discharge a uniform dispersion of the shot against the disk.

The nozzle 40 may be suitably mounted for effecting the desired shallow incidence angel A relative to the disk surface. And, either the disk may be moved, or the nozzle may be moved for traversing the shot stream around the entire perimeter of the rotor disk for scrubbing the entrance and exit corners of the individual dovetail slots in turn.

As shown in FIG. 2, the nozzle 40 is suitably directed along the edges of the individual dovetail slots for scrubbing thereof. As shown in FIG. 3, the shot 28 is directed at the slot corners 20 and travels firstly over the adjoining plug 24 which defines the step corner 20 thereat. Since the abrasive action of the shot is directional and requires impingement against a protruding surface such as the corner, only the downstream sides of the disk slots are abraded for a specific incidence direction of the shot, as illustrated in FIG. 4.

The downstream, or right slot corner 20 is abraded by the action of the pliant shot which is directed thereat upstream therefrom. The left or upstream slot corner 20 itself is not significantly abraded since it lies in the shadow or wake of the shot stream. However, any burr 22, illustrated in phantom line, protruding outwardly from the disk surface will be abraded by the pliant shot.

In order to fully scrub the entire edge of the disk slot, the orientation of the shot stream must be adjusted to impact the slot corners 20 in the preferred orientation illustrated in FIG. 4. The direction of travel of the shot stream is preferably maintained substantially normal to that portion of the slot corner 20 being scrubbed. As shown in FIG. 2, the nozzle 40 may be suitably directed and aimed to traverse the entire entrance and exit edges of the individual dovetail slots in any suitable manner, such as in turn.

In one embodiment tested for sustained surface scrubbing of a flat plate, an incidence angle A of about 30° effected scrubbing contact along the surface without appreciable rebound for at least several centimeters. Sustained surface scrubbing was also observed at an incidence angle of up to about 45°.

The incidence angle A may be varied along with the operating air pressure of the delivery apparatus 32 illustrated in FIG. 1, and the type of pliant shot used, and may ranged up to about 60°, for example. The limit on the incidence angle A is that angle at which the shot experiences rebounding off a flat surface at the impact site with a corresponding loss in lateral or sustained scrubbing thereof. And, excessive incidence angles should be avoided which would cause the abrasive in the pliant shot to imbed in the target surface.

Impingement of the pliant shot causing rebounding thereof is undesirable since the material-removal performance of the shot then occurs in similar amounts over the target material as well as the adjoining surface within the impact site. And, normal to the surface impingement of abrasive is undesirable since the abrasive may become imbedded in the workpiece surface.

In contrast, sustained surface scrubbing carries the shot 28 generally parallel along the surfaces of the plug and disk with little or no material removal therefrom, while laterally impinging the protruding corners 20 and any burrs 22 thereon. The target protrusions are readily abraded by the shot without significantly affecting the disk surface, and, in particular, while maintaining the original smooth finish thereof.

As shown in FIG. 2, the disk also includes other apertures such as the disk holes 14 drilled axially therethrough. The entrance side of the holes is typically sharp and the exit side of the holes typically forms burrs 22 along the hole corners, also designated 20. In a manner similar to treating the dovetail slots 12, the bolt holes 14 are also filled with corresponding plugs 24, preferably in a common molding operation with the plugs in the dovetail slots. The hole plugs are also recessed below the exposed surface 18 of the disk below the hole corners 20 to define corresponding steps 26 thereat.

The nozzle 40 may be redirected around the perimeter of each of the bolt holes at the desired shallow incidence angle and initially directed atop the plugs 24 for scrubbing therealong until impinging the hole corners 20. In this way, the shot scrubs over the corners for abrasion thereof and removal of any burrs 22 thereat. The hole corners are scrubbed to form precise arcuate radii down to the surface of the plugs themselves. In a manner similar to scrubbing the dovetail slots, the corners of the bolt holes are scrubbed and provided with precise corner radii down to the plugs, with the plugs protecting the inside of the bolt holes from abrasion.

Accordingly, the rotor disk 10 disclosed above may be initially formed to near final configuration with corresponding near final surface finish prior to the broaching of the dovetail slots, or drilling of the bolt holes, or forming any other required machined features therein. The plug 24 in its various configurations may then be suitably molded over the disk to fill the several dovetail slots, bolt holes, or other apertures to provide the desired steps at corresponding edges or corners thereof.

The pliant shot 28 may then be directed at the shallow incidence angle upstream from corresponding corners for practicing sustained surface scrubbing thereof in which the surfaces of the plug and disk oriented parallel to the scrubbing shot is thusly protected therefrom, with the shot abrading primarily only protruding corners in the line of travel. The nozzle is redirected as required to traverse the full extent of the edges or corners of the dovetail slots and bolt holes and other apertures, including entrance and exit sides thereof, for removing burrs and providing precise and controlled radii thereat.

The size of the shot stream may be selected to provide a suitably large impact site which may cover one or more of the apertures and adjoining surface for decreasing the processing time. By controlling and limiting the scrubbing effect at each impact site, material may be removed primarily only from the intended stepped corners, with little, if any material removal from the exposed adjoining surfaces of the workpiece. In this way, the shot stream may be traversed over the entire intended surface of the workpiece to selectively remove material solely at the edges or corners of the apertures, while protecting the adjoining exposed surfaces therearound.

Upon completion of the scrubbing of the entire workpiece, the plug may then be removed, and reused on a subsequent workpiece by insertion therein. The preferred polyurethane plug itself has significant resistance to abrasion by the shot which is scrubbed thereover and may be reused several times prior to accumulating any damage which would affect the depth of the step and the corresponding extent of the corner radii.

Sustained surface scrubbing of the workpiece to deburr and radius various edges or corners thereof is readily effected in one processing operation without the need for subsequent processing operations as otherwise required in previous practice. Processing time is significantly reduced, and the cost of deburring and radiusing the workpiece correspondingly reduces. And, the simplicity of the scrubbing process and the precise corner radiusing controlled by the plug substantially reduce or eliminate the likelihood of operator error, which in turn reduces the likelihood of forming defects in the workpiece requiring scrapping thereof.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims in which I claim:

1. A method of treating a surface adjoining an aperture at a corner in a workpiece comprising:

filling said aperture with a plug; and discharging a stream of pliant shot in a carrier fluid at a shallow angle of incidence against said plug and directed toward said corner for abrasion thereof.

2. A method according to claim 1 further comprising scrubbing said shot laterally along said plug for selectively removing material at said corner.

3. A method according to claim 1 further comprising:

discharging said shot stream against both said plug and surface; and scrubbing said shot laterally along said plug and surface for selectively removing material at said corner.

4. A method according to claim 3 wherein said shot is scrubbed parallel to said surface for protection thereof, and inimpingement against said corner for selective abrasion thereof distinctly from said adjoining surface.

5. A method according to claim 4 wherein:

said plug is recessed below said surface to define a protruding corner thereat; and said shot is scrubbed along said plug and over said corner for abrasion thereof.

6. A method according to claim 5 wherein said workpiece comprises a rotor disk, and further comprising:

broaching a perimeter of said disk to form a dovetail slot therein defining, said aperture adjoining a side surface thereof; and scrubbing said shot over said corner for abrasion thereof.

7. A method according to claim 6 wherein said broaching forms a burr along said corner, and said scrubbing removes said burr therefrom.

8. A method according to claim 6 wherein said corner is scrubbed to form a radius down to said plug.

9. A method according to claim 6 further comprising scrubbing said disk surface and said corner without changing finish of said surface adjoining said corner.

10. A method according to claim 6 wherein said shot comprises open-cell sponge.

11. A method according to claim 10 wherein said shot further comprises abrasive particles imbedded therein.

12. A method according to claim 11 wherein said sponge shot comprises polyurethane.

13. A method according to claim 6 further comprising removing said plug after scrubbing said corner.

14. A method according to claim 5 wherein said workpiece comprises a rotor disk, and further comprising:

drilling said disk axially therethrough to form said aperture; and scrubbing said shot over said aperture corner for abrasion thereof.

15. A method according to claim 14 wherein said drilling forms a burr along said corner, and said scrubbing removes said burr therefrom.

16. A method according to claim 14 wherein said corner is scrubbed to form a radius down to said plug.

17. A method of radiusing a corner between an aperture and adjoining surface of a rotor disk comprising:

filling said aperture with a plug to expose said corner; and discharging a stream of pliant shot in a carrier fluid at a shallow angle of incidence against said plug and directed toward said corner for radiusing thereof.

18. A method according to claim 17 further comprising:

discharging said shot stream against both said plug and surface; and scrubbing said shot laterally along said plug and surface for selectively removing material at said corner.

19. A method according to claim 18 further comprising:

broaching a perimeter of said disk to form a dovetail slot therein defining said aperture adjoining a side surface thereof; and scrubbing said shot over said corner for radiusing thereof.

20. A method according to claim 18 further comprising:

drilling said disk axially therethrough to form said aperture; and scrubbing said shot over said corner for radiusing thereof.

21. A method of deburring a corner between an aperture and adjoining surface of a rotor disk comprising:

filling said aperture with a plug to selectively expose burrs at said corner; and discharging a stream of pliant shot in a carrier fluid at a shallow angle of incidence against said plug and directed toward said corner for deburring thereof.

22. A method according to claim 21 further comprising:

discharging said shot stream against both said plug and surface; and scrubbing said shot laterally along said plug and surface for selectively removing said burrs at said corner.

23. A method of scrubbing a corner at an aperture in a workpiece comprising:

filling said aperture with a plug to expose target material at said corner; and discharging a stream of pliant shot in a carrier fluid at a shallow angle of incidence against said plug and directed toward said target material for abrasive scrubbing thereof.

24. A method according to claim 23 wherein said target material includes a burr at said corner protruding outwardly from an exposed surface of said workpiece, and said shot is directed toward said burr for deburring said corner.

25. A method according to claim 24 further comprising scrubbing said corner to remove said burr without changing finish of said exposed surface adjoining said corner.

26. A method according to claim 23 further comprising recessing said plug to expose a step at said corner as said target material, and scrubbing said corner at said step to radius said corner.

27. A method according to claim 26 further comprising radiusing said corner without changing finish of an exposed surface of said workpiece adjoining said corner.

* * * * *